US006418406B1

(12) United States Patent
Viswanathan et al.

(10) Patent No.: US 6,418,406 B1
(45) Date of Patent: Jul. 9, 2002

(54) SYNTHESIS OF HIGH-PITCHED SOUNDS

(75) Inventors: Vishu R. Viswanathan, Plano; Wai-Ming Lai, Dallas, both of TX (US)

(73) Assignee: Texas Instruments Incorporated, Dallas, TX (US)

( * ) Notice: Subject to any disclaimer, the term of this patent is extended or adjusted under 35 U.S.C. 154(b) by 700 days.

(21) Appl. No.: 08/702,422

(22) Filed: Aug. 14, 1996

Related U.S. Application Data

(60) Provisional application No. 60/002,260, filed on Aug. 14, 1995.

(51) Int. Cl.[7] ..... G10L 19/00

(52) U.S. Cl. ..... 704/207; 704/219; 704/220

(58) Field of Search ..... 84/622, 623, 633, 84/609; 704/222, 230, 207, 220, 268, 269, 219

(56) References Cited

U.S. PATENT DOCUMENTS 5,536,902 A * 7/1996 Serra et al. ..... 84/623
5,581,652 A * 12/1996 Abe et al. ..... 704/222
5,641,927 A * 6/1997 Pawate et al. ..... 84/609

* cited by examiner

*Primary Examiner*—William Korzuch
*Assistant Examiner*—Daniel Abebe
(74) *Attorney, Agent, or Firm*—Robert L. Troike; Frederick J. Telecky, Jr.

(57) ABSTRACT

An improvement in the synthesis of high-pitched voices and sounds is provided by downshifting the pitch 11 of the original input voice or sound before LPC analysis 13. This downshifting of the pitch is provided by upsampling 21, low pass filtering 22, downsampling 23, and performing time scale modification 24.

10 Claims, 3 Drawing Sheets

SYNTHESIS OF HIGH-PITCHED SOUNDS

This application claims priority under 35 USC §119 (c) (1) of provisional application No. 60/001,260, filed Aug. 14, 1995.

TECHNICAL FIELD OF THE INVENTION

This invention relates to synthesis of sounds and more particularly to the synthesis of high-pitched sounds.

BACKGROUND OF THE INVENTION

The Mixed Signals Products group of Texas Instruments Semiconductor Division (SC/MSP) has an LPC (Linear Predicting Coding) synthesis semiconductor chip business with its family of TSP50C1X and MSP50C3X microprocessors. The synthesis is where a signal such as a human voice or sound effect such as animal or bird sound to be synthesized is first analyzed using a linear predictive coding analysis to extract spectral, pitch, voicing and gain parameters. This analysis is done using a Speech Development Station 10 as shown in FIG. 1 which is a workstation with a Texas Instruments SDS5000. The SDS5000 consist of two circuit boards 10*a* plugged into two side by side slots of a personal computer (PC). The PC includes a CPU processor and a display and inputs 10*b* such as a keyboard, a mouse, a CD ROM drive and a floppy disk drive. Using one of the inputs like a CD ROM, the voice or sound to be synthesized is entered for analysis. The station also includes a speaker and the user editing can listen to the sound as well as view the display generated by the SDS5000. The analysis is typically done at a rate of 50–100 times per second. The display gives a time plot of the raw speech spectrum, pitch, energy level and LPC filter coefficients. These parameters may then be edited, if necessary, and quantized to a data rate of typically 1500–2400 bits/second. The data rate is kept low to reduce the memory needed to store the data in the product being created. The foregoing analysis is performed off-line and the LPC parameters are stored into the memory M of a synthesis product such as a talking toy or book shown in FIG. 2. The book for example contains a microprocessor $\mu$P that is coupled to a ROM memory M that when a button is pressed processes using LPC model data producing the sound to a speaker S. The digital signal converted to analog signal and applied to a speaker in the book or toy. The coefficients for that sound corresponding to the button depressed are taken from the memory.

For high-pitched sounds, the LPC method does not provide a good spectral model. One such high-pitched sound may be a child's voice to be used in a talking book.

For high-pitched sounds, the LPC method instead of modeling the resonances of the vocal tract tends to model individual pitch harmonics. The resulting poor spectral modeling leads to poor synthesizer output quality. Any reasonable editing of spectral parameters will not, in general, solve the output quality problem.

SUMMARY OF THE INVENTION

According to one embodiment of the present invention the synthesis of high-pitched sounds is improved by lowering the pitch of the original signal to be synthesized by a constant percentage. The lower pitch-shifted signal is then applied to an LPC analysis to extract the desired spectral parameters.

DESCRIPTION OF THE PREFERRED EMBODIMENT

Figure 3:
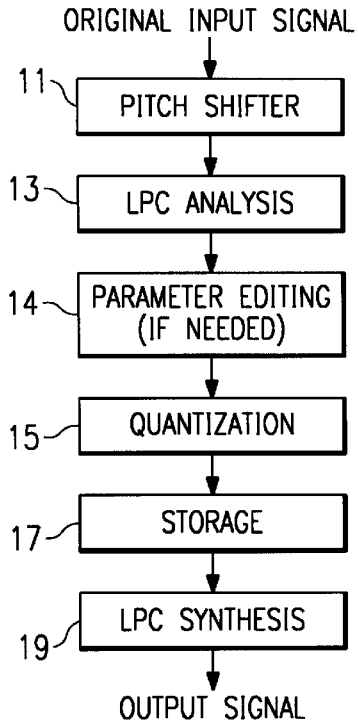
FIG. 3 is a flow chart for linear prediction synthesis of high-pitch sounds according to one embodiment of the present invention.
Figure 4:
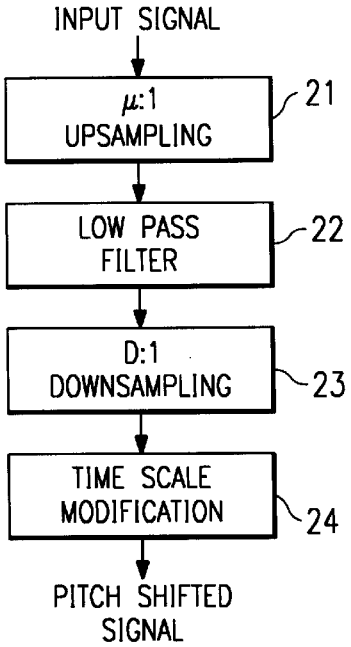
FIG. 4 is a block diagram of the phase shifter of FIG. 3.

Referring to FIG. 3, the original high-pitched voice or sound effect is pitch-shifted at pitch shifter 11 and changed to a lower pitch. The so-called resampling approach is used, for example. In the direct resampling method, the output sampling rate of a digital to analog converter is held constant. The input signal is interpolated to lower the pitch. This is illustrated in FIG. 4 for a 3/2 case. The input signal is first upsampled by 3 and downsampled by 2. In the upsampling, for every input sample, one inserts two zeros. If, for example, we have three original samples, we will have 9 samples after upsampling. The upsampled output is low pass filtered at filter 22 to smooth out the curve. After it is low pass filtered it is downsampled by a factor of D where the first sample is kept and the next (D−1) samples are thrown away. When D is 2, the new pitch period is 3/2 times the original value or 50% longer and the pitch frequency is therefore lowered by 50 percent, as the pitch period and frequency are inversely related. This method has the drawback that the duration of the output signal is altered and the spectral envelope of the original signal is modified. The duration problem may be corrected by time-scale modification (step 24). In this method the output of the resampler is processed in order to have an output signal duration equal to the input signal duration. A technique for modifying time-scale is called "Synchronized Overlap and Add (SOLA)". See article entitled "Time-Scale Modification in Medium to Low Rate Speech Coding," by J. Makhoul and A. El-Jaroudi in Proceedings of IEEE International Conference on Acoustics, Speech, and Signal Processing (ICASSP) 1986, page 1705–1708.

The SOLA method achieves time-scale modification while preserving the pitch. Synchronization is achieved by concatenating two adjacent frames at regions of highest similarity. In this case, similar regions are identified by picking the maximum of a cross-correlation function between two adjacent frames over a specified range.

When applying SOLA, choice of N, the frame-size, is an important factor. In general, N must be at least twice the size of the pitch period of the sound; e.g., for signal with a 100 Hz pitch, sampled at 10 KHZ, N must be at least 20 ms or 200 samples. If N is smaller than this, the lower frequency portion of the signal will be distorted.

For speech, the optimum value for N appears to be about 20 ms (milliseconds). For music, containing low frequency sounds, we found through experimentation that N had to be increased to about 40 ms.

The residual resampling method tries to alleviate the drawback of the direct resampling method by resampling and time-scale modifying the residual of the LPC (Linear Predicting Coding) model. The poles of the LPC model help maintain the original spectral envelope in the pitch-shifted signal.

The residual of the LPC model contains the pitch and is also known to be almost spectrally flat. Hence, the residual signal is sifted and time-scale modified, and the output is resynthesized using the LPC parameters and the modified residual. The residual resampling method of lowering pitch is better suited to synthesis application.

Figure 1:
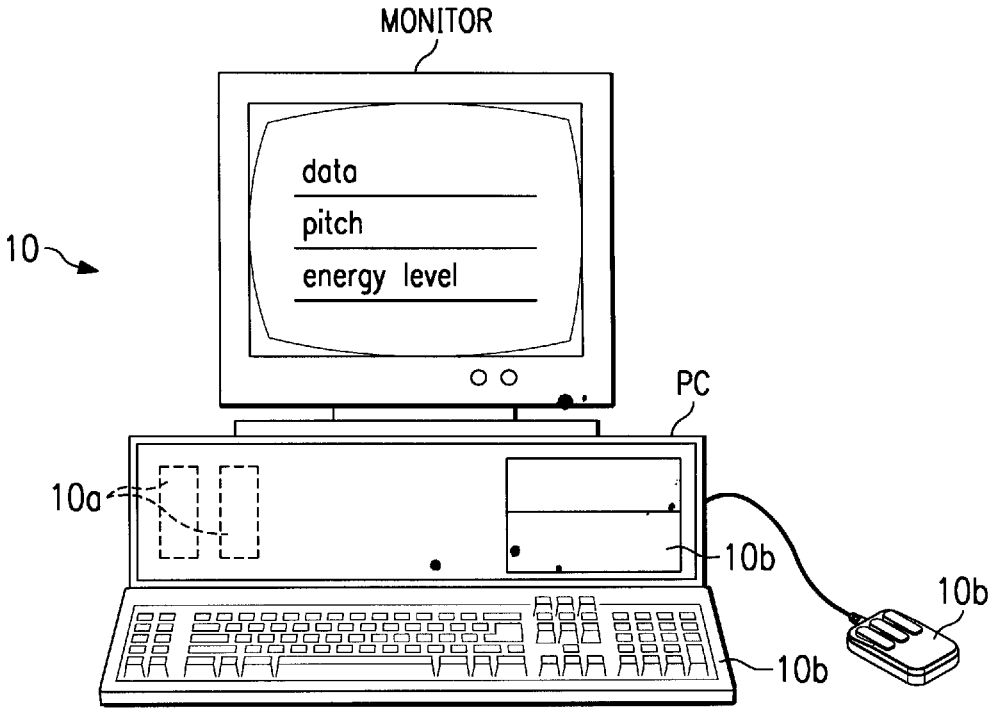
FIG. 1 is a sketch of a Speech Development Station.
Figure 2:
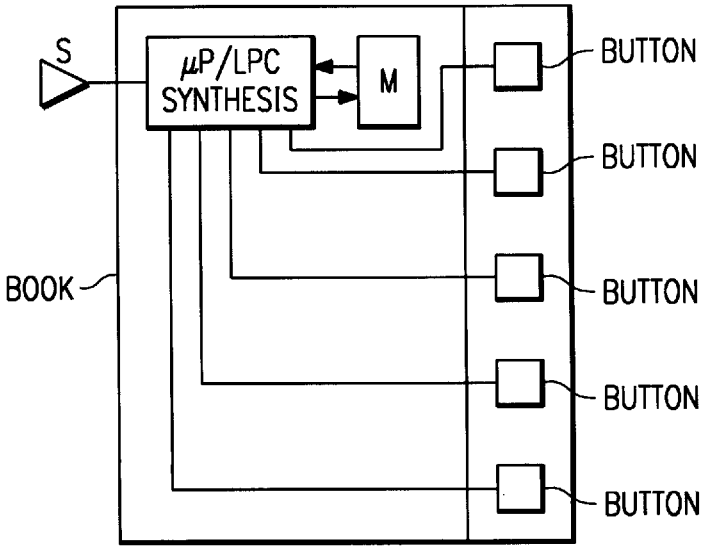
FIG. 2 is a sketch of a synthesis product.

The pitch-lowered signal then undergoes the LPC analysis 13 to provide the spectral parameters at the rate of 50–100 times per second. These may be edited 14 and are quantized 15 to a data rate, for example, of 1500–2400 bits/sec. This quantized data may be stored in a storage 17. The frame by frame pitch data may be restored to their original values, if that is required by the synthesizer output. If the pitch change is small it may not be necessary to restore the pitch for the output. The edited and quantized signal data may be transferred from storage in the Speech Development Station (SDS) into the memory of the synthesis product such as that of FIG. 2 that includes the microprocessor such as MSP50C3X of Texas Instruments Incorporated.

Figure 5:
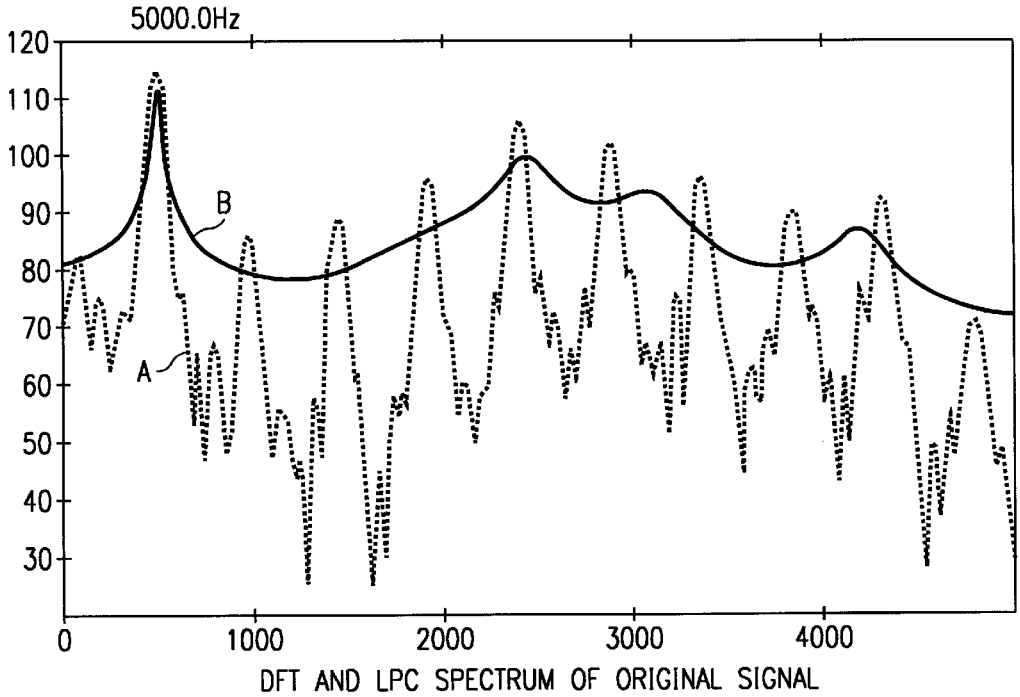
FIG. 5 is a plot of raw speech spectrum and its LPC model spectrum for a child's voice with a plot of about 476 Hz.

In one embodiment this technique was used for a high pitched child's voice. The pitch of the original signal was 476 Hz. The pitch was reduced by increasing the pitch period by 25%, which reduces the pitch by 20% to about 380 Hz. In Curve A of FIG. 5 there is illustrated the spectrum of raw speech. This spectrum is from a 20 milliseconds (ms) frame of data that has been Fourier transformed using FFT (Fast Fourier Transform) to compute amplitude at each frequency. The peaks are the harmonics of the pitch. They represent harmonics of the pitch frequency. For higher pitch frequencies the peaks are farther apart and the spectral resolution is poor. Curve B in FIG. 5 shows the spectrum of the LPC model for the same 20 ms frame of speech used for Curve A. As mentioned above, the LPC model extracts the resonances; for the higher pitch case, the LPC model represents the first formant as a very sharp peak as shown in Curve B of FIG. 5 and for the lower frequency of FIG. 6 it is less sharp. The very sharp peak for the first formant in FIG. 5 results in a signal that sounds noticeably distorted.

Figure 6:
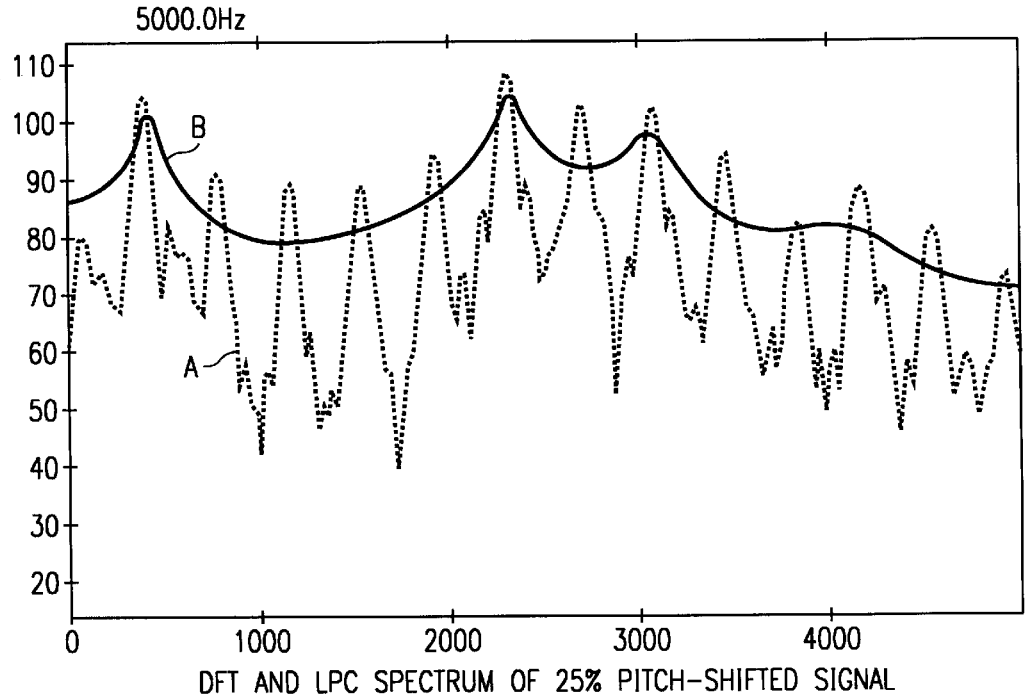
FIG. 6 is a plot of raw speech spectrum and its LPC model spectrum after lowering pitch frequency by 20%, for the child's voice in FIG. 5.

From comparison of FIGS. 5 and 6, we see that LPC model spectrum given in FIG. 6, which is obtained by lowering pitch frequencies by 20%, provides a better representation of the underlying speech resonances, especially the first resonance (or formant), than the one in FIG. 5. The LPC spectrum (curve) in FIG. 5 has a very peaky first formant, which leads to unnatural sounding speech output. The LPC spectrum in FIG. 6, (curve B) on the other hand, leads to acceptable quality speech output. Curve A of FIG. 6 illustrates raw spectrum of pitch-shifted speech.

Although the present invention and its advantages have been described in detail, it should be understood that various changes, substitutions and alterations can be made herein without departing from the spirit and scope of the invention as defined by the appended claims.

What is claimed is:

1. A method for synthesizing high-pitched sounds comprising the steps of:

shifting pitch of a high-pitched sound signal to a lower pitch;

after shifting pitch to a lower pitch performing LPC analysis of the lower pitch sound signal to extract the desired spectral parameters, and quantization of said spectral parameters to a desired data rate.

2. The method of claim 1 wherein the step before quantization the step of performing parametric editing.

3. The method of claim 1 wherein the step of shifting pitch includes the steps of upsampling, low pass filtering, downsampling, and time scale modification.

4. The method of claim 3 including the step of storing said spectral parameters.

5. The method of claim 4 including the step of reproducing copies of said stored spectral parameters and storing a copy of said copies in a storage medium.

6. The method of claim 5 including the steps of coupling a microprocessor to said storage medium and a speaker to reproduce the sound signal.

7. A method for synthesizing a high-pitched child's voice comprising the steps of:

reducing the pitch of the high-pitched child's voice by about 20 percent to produce a lower pitch sound signal;

after reducing the pitch by about 20 percent, performing LPC analysis of the lower pitch sound signal to extract spectral parameters; and quantization of said spectral parameters to a desired data rate.

8. The method of claim 7 wherein the step of reducing pitch includes the steps of upsampling, low pass filtering, downsampling and time scale modifications.

9. The method of claim 7 including the step of storing said spectral parameters.

10. The method of claim 7 wherein the step before quantization the step of performing parameteric editing.

* * * * *